United States Patent [19]

Unrinin

[11] Patent Number: 4,762,243

[45] Date of Patent: Aug. 9, 1988

[54] DRY CONTAINER CAPABLE OF ACCOMMODATING BULK CARGO

[75] Inventor: Nobuyuki Unrinin, Miki, Japan

[73] Assignee: Kawasaki Kisen Kaisha, Ltd., Hyogo, Japan

[21] Appl. No.: 89,313

[22] Filed: Aug. 25, 1987

[30] Foreign Application Priority Data

Sep. 19, 1986 [JP] Japan ..... 61-142605[U]

[51] Int. Cl.[4] ..... F26B 25/12

[52] U.S. Cl. ..... 220/22; 34/237; 43/238

[58] Field of Search ..... 220/22.3, 22.5, 22; 34/237, 238, 239, 240, 209, 201

[56] References Cited

U.S. PATENT DOCUMENTS

| | | | |
|---|---|---|---|
| 220,301 | 10/1879 | Morse | 34/237 |
| 448,846 | 3/1891 | Conklin | 34/237 |
| 697,237 | 4/1902 | Collins | 34/238 |
| 1,171,486 | 2/1916 | Warner | 34/238 |
| 2,456,481 | 12/1948 | Ballantyne et al. | 34/238 |
| 2,985,333 | 5/1961 | Kirkman | 220/22.3 |
| 3,656,651 | 4/1972 | Hage | 220/22.3 |
| 4,319,795 | 3/1982 | Klaus | 220/22.3 |

*Primary Examiner*—Joseph Man-Fu Moy

*Attorney, Agent, or Firm*—Kane, Dalsimer, Sullivan, Kurucz, Levy, Eisle and Richard

[57] ABSTRACT

A dry container capable of accommodating bulk cargo, which consists a hexahedral vessel having its door opening onto at least one side shell face thereof, said dry container comprising a pair of longitudinal corner-post grooves facing each other disposed near the door opening, reinforcement rigid members, whose each end is inserted into each corresponding groove, arranged a set at a distance to each other and each bridging the front corner posts, and a flexible inner-container-bag arranged inside the space defined by the plane including the set of reinforcement rigid members disposed in the dry container and by other shell faces than the face nearest the rigid members so as to fit the bag sheet onto these container shell faces and the rigid members.

9 Claims, 2 Drawing Sheets

DRY CONTAINER CAPABLE OF ACCOMMODATING BULK CARGO

BACKGROUND OF THE INVENTION

1. Field of the Invention

The present invention relates to a dry container which is capable of accommodating bulk cargo and is formed into a hexahedron with its door opening provided at least on one side face other than the ceiling or the floor thereof.

2. Description of the Prior Art

Heretofore, it is common in the transportation of bulk cargo to use a bulk container for exclusive use therefore. However, since there are not so many bulk-cargo-only container and since, in addition, they are expensive, it has recently been expected to use so-called dry containers for transporting bulk cargo by dealers dealing with large scale mass transportation of bulk cargo. In this respect, there have, up to date, been proposed measures for utilizing dry containers for transportation of bulk cargo: e.g., the sheets made of, such as, vinyl resin film sticks to the inside of the rear panel, both side-panel, ceiling and floor of the container and to the container-bulkhead frame made of wooden ladder fixed under insertion into grooves formed in the corner posts of the dry container, or steel pipe or lightweight shape steel welded onto said grooves: and the bulkhead consisted of parallel reinforcement members of steel pipe or lightweight shape steel supported on a meshed sheet by suspending them from lashing beams disposed at both of the front ends of the container ceiling is combined with an inner-container-bag which is specifically designed for exclusive use therefor (Japanese Utility Model Application laid Open No. Sho-61-45393 and No. Sho-61-45394).

In the prior techniques, however, many inconveniences to be improved are included. For example, in the case of wooden bulkhead frame, an insufficient strength and thus a danger of so-called devanning or unpacking would have often to be taken into account of, together with time-consuming and laborious in situ works for assembling and disassembling the container-bulkhead, in addition to the circumstances that there is sometimes a difficulty in the availability of wooden frame, since some countries are now prohibiting importation of the wooden materials. In the case of employment of steel pipes or lightweight shape steel for a container-bulkhead frame, though they are satisfactory in the strength, considerable time will be required for removing it after it has been assembled by welding and, thus, the general and multi-purporse uses of the dry container becomes restricted. In the case of the suspending bulkhead having parallel reinforcement members, it is necessary to put suspending hook members at both of the front ends of the container ceiling and, in some cases, it will be necessary to install such suspending hook members newly in the container, so that the utility of dry container is restricted.

As to the inner-container-bag, not only the laying down and fixation thereof are laborious, but also there may occur a danger of swelling out of the bag due to an internal pressure of the bulk materials charged, what may cause a further employment of additional supporting means, such as, veneer board support etc. to be necessary as auxiliary materials.

BRIEF SUMMARY OF THE INVENTION

The object of the present invention is to remedy such difficulties as mentioned above concomitant to the utilization of dry container for a bulk cargo transportation and to enable conventional dry containers as such to be charged with bulk cargo.

The above object is achieved according to the present invention in the dry container mentioned at the beginning of the description, by installing rigid members, whose ends are inserted into corner-post-grooves facing each other disposed near the door openings, arranged with distance to each other and each briding between a pair of front corner posts, on the one hand, and a flexible inner-container-bag arranged inside the space defined by the plane including the set of reinforcement rigid members disposed in the dry container and by other five shell faces than the face nearest the rigid members so as to fit the bag sheet onto these container shell faces and the rigid members. the corner posts have already been provided with such grooves, they can be employed as such for the purpose of the present invention.

It may be effective for the purpose of the present invention that the reinforcement rigid member is made of a shape steel and is, particular, profile steel furnished at both ends each with a spacer leg to constitute member having a shape of shallow inverted U.

It may be more effective, if the reinforcement member is composed of truss member (denoted hereinafter as frame member), which bridges a pair of front corner posts, and of spacer legs each connected to each end of the frame member through hinges.

It is also possible that the frame member of the reinforcement rigid member is provided at both ends with a retaining part for recieving the space leg of another reinforcement member so as to permit a simple assemblage of the reinforcement members by pile one another with the spacer legs inserted into the corresponding corner-post-grooves under engagement of the spacer legs with the corresponding retaining part. The spacer legs may be constructed in a extendable or a disconnectable structure. It is possible to employ vertical connection rods linked to the reinforcement members of a bulkhead to facilitate the support of the flexible inner-container-bag.

Alternatively, the reinforcement rigid member may be composed of a frame member and of elongated members having each a size suitable for engaging with the corner-post-groove under insertion thereinto and having further on its longitudinal wider face a suitable number of projections which serve to support the frame member upon engagement with the corner-post-grooves.

It may also be convinient, to sustain the flexible inner-container-bag by suspending it from the top side rails using, for example, double-face adhesive tapes attached on flat faces thereof.

BRIEF DESCRIPTION OF THE DRAWINGS APPENDED

DETAILED DESCRIPTION OF THE INVENTION

Conventional dry containers are, in general, provided with a pair of corner posts at both sides of the door opening, each of which has a groove at such a position that these grooves of posts are in opposition to each other, so that these is no need for specifically incorporating additional members for supporting the bulkhead. Using the reinforcement rigid members according to the present invention, a sufficient strength is offered without relying upon any special auxiliary means and also the devanning time can be decreased. Using the reinforcement members of a shape of shallow inverted U each having a spacer leg at each of its both ends, an auxiliary installed type bulkhead can be brought about, which is easier in the preparation as compared with conventional suspension bulkheads. Here, it is possible to determine the distance between the reinforcement members suitably in accordance with the internal pressure caused by the bulk cargo and with the strength of each particular flexible inner-container-bag employed, by selecting the length of the spacer legs, and thus, the width between the reinforcement members suitably. Thus, the utilization fields can be made wider by suitable conbination of various spacer leg lengths with the frame members of various sizes. The reinforcement member having spacer legs coupled by hinge-connection offers a benefit of facilitation of its transportation. The reinforcement member having extendable spacer legs brings about greater flexibility in its practical use, since one and the same reinforcement member can be used in different transportation conditions for various bulk cargos. In the case of employing detachable or removable space legs, same effect can be achieved by incorporating varying lengths of space members. The reinforcement rigid member according to the present invention which is composed of a frame member and two elongated members each having a size suitable for engagement with the corner-post-groove and provided on the longitudinal weider face thereof a number of projections will meet the different transportation conditions of various bulk cargos by using it in a suitable number as a set distributed at suitable locations on said wider face. Also, the capability of repeated use of reinforcement members according to the invention contributes to the economy in the container transportation of bulk cargo.

The flexible inner-container-bag is set inside the space defined by the plane of alignment of the reinforcement members and by other five shell faces than the face nearest the rigid members by fitting the bag sheet wth these surrounding faces, what requires only a brief time with little labor.

The invention can also be applied to dry containers without lashing ring by suspending the flexible inner-container-bag from the top side rails of dry container using, for example, double-face adhesive tapes attached at their one end to a flat face of the rail.

DETAILED DESCRIPTION OF PREFERRED EMBODIMENTS

Figure 1:
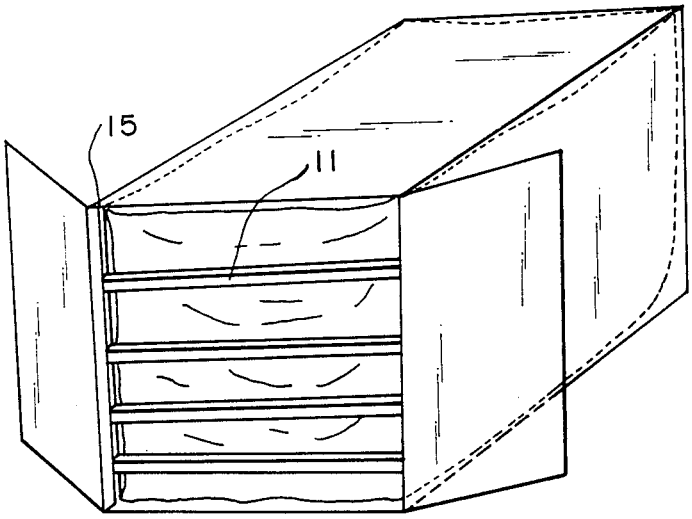
FIG. 1 is a schematic illustration of one embodiment of the present invention.
Figure 2:
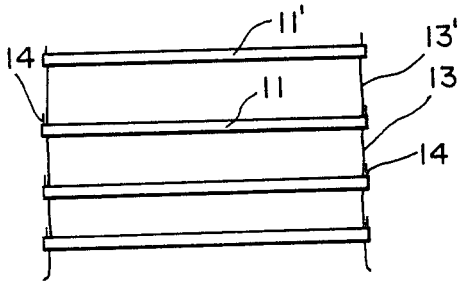
FIG. 2 shows an embodiment of the bulkhead according to the present invention under practical use.
Figure 3:
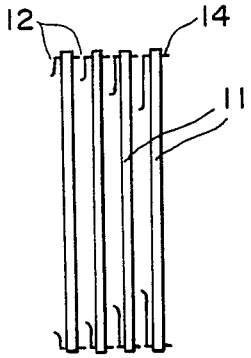
FIG. 3 shows an alternative embodiment of reinforcement members put together for packaging.
Figure 4:
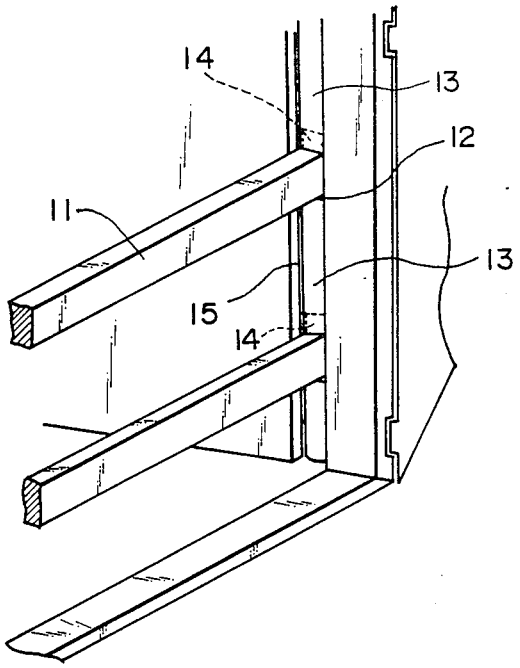
FIG. 4 illustrates the reinforcement members in a state of being inserted into the corner-post-grooves.

Below, the present invention will further be described by way of an example with reference to the attached drawings. A reinforcement rigid member of lightweight shape steel rod having a length suitable for bridging between a pair of front corner posts under engagement with the grooves thereof consists of a frame member (11) and a pair of spacer legs (13) each connected to either end of the frame member (11) through a hinge (12), wherein the frame member is provided on the upper face at each end thereof with a retaining part (14) of a size suitable for allowing the spacer leg (13') of another frame member (11') to be inserted therein. An adequate number of the so constructed rigid reinforcement members are held under engagement of their spacer legs with the grooves (15) of the corner posts of dry container (FIG. 1) attained by simply placing the reinforcement members one over another so as to fit the spacer legs (13) to the corresponding retaining parts (14).

Figure 5:
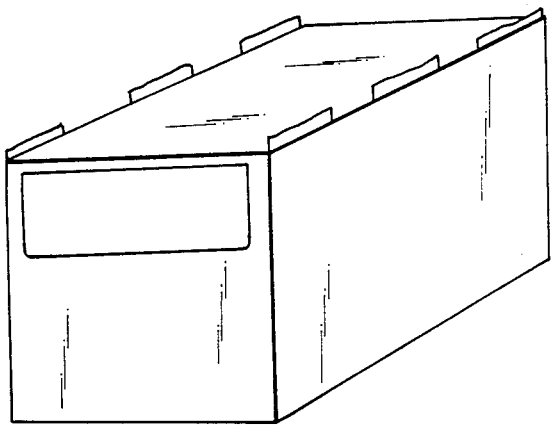
FIG. 5 is a perspective view of one embodiment of the flexible inner-container-bag according to the present invention.

As shown in FIG. 5, a flexible inner-container bag prepared accommdated to the size of the dry container is furnished with lugs on its upper edges, to which double-face adhesive tapes are attached. The bag is then set in the dry container and, by fastening it further to lashing rods existing at the four corners of the dry container using, for example, cords, ropes or the like, the sustaining of the bag will futther be reinforced.

What is claimed is:

1. A dry container capable of accommodating bulk cargo, which consists of hexahedral vessel having its door opening onto at least one side shell face thereof, comprising a pair of longitudinal corner-post-grooves facing each other disposed near the door opening, a set of reinforcement rigid members, whose each end is inserted into each corresponding groove, arranged with distance to each other and each bridging between a pair of front corner posts, and a flexible inner-container-bag arranged inside the space defined by the plane including the set of reinforcement rigid members disposed in the dry container and by other five shell faces than the face nearest the rigid members so as to fit the bag sheet onto these container shell faces and the rigid members.

2. A dry container according to claim 1, wherein the reinforcement rigid member is made of shape steel.

3. A dry container according to claim 1, wherein the reinforcement rigid member is made of shape steel provided at both ends each with a spacer leg to constitute a member having a shape of shallow inverted U.

4. A dry container according to claim 3, wherein the reinforcement rigid member consists of a truss member bridging between a pair of front corner posts and of spacer legs each connected to each end of the truss member through hinges.

5. A dry container according to claim 4, wherein the reinforcement rigid member has at each end thereof a retaining part for receiving the spacer leg of another reinforcement rigid member to permit a simple assamblage of the reinforcement rigid members by pile one another with the spacer legs inserted into the corner-post-grooves under engagement with the corresponding retaining parts.

6. A dry container according to either one of claims 3 to 5, wherein the reinforcement rigid member has extendable spacer legs.

7. A dry container according to either one of claims 3 to 5, wherein the spacer legs are detachably arranged.

8. A dry container according to either one of claims 3 to 5, wherein the flexible inner-container-bag is suspended from the top side rails in the container.

9. A dry container according to either one of claims 1 and 2, wherein the set of reinforcement rigid members consist of frame members having a length suitable for bridging between a pair of front corner posts, and of a pair of parts having suitable dimensions for inserting into the corner-post-groove provided on its one longitudinal wider face with a suitable number of projections.

* * * * *

UNITED STATES PATENT AND TRADEMARK OFFICE

CERTIFICATE OF CORRECTION

PATENT NO. : 4,762,243

DATED : August 9, 1988

INVENTOR(S) : Nobuyuki Unrinin, Miki, Japan

It is certified that error appears in the above-identified patent and that said Letters Patent is hereby corrected as shown below:

In column 6 line 6 the correct spelling should be --longitudinal--.

Signed and Sealed this

Tenth Day of January, 1989

*Attest:*

DONALD J. QUIGG

*Attesting Officer*

*Commissioner of Patents and Trademarks*